US005477633A

United States Patent [19]

Leinberger

[11] Patent Number: 5,477,633

[45] Date of Patent: Dec. 26, 1995

[54] DOCUMENT HOLDER FOR WEARER'S LIMB

[76] Inventor: David C. Leinberger, 520 Grape St., Denver, Colo. 80220

[21] Appl. No.: 163,307

[22] Filed: Dec. 8, 1993

Related U.S. Application Data

[63] Continuation-in-part of Ser. No. 984,880, Dec. 2, 1992, abandoned.

[51] Int. Cl.[6] ..... G09F 3/18

[52] U.S. Cl. ..... 40/661; 40/586; 40/660; 40/644; 40/633; 2/16

[58] Field of Search ..... 40/661, 660, 586, 40/904, 663, 665, 644, 633, 115; 2/16, 59, 160, 161.6, 161.1, 161.4, 162, 170; 224/267, 191, 219, 221, 222, 901; 150/145; D2/610, 623, 624

[56] References Cited

U.S. PATENT DOCUMENTS

| | | | |
|---|---|---|---|
| 2,711,202 | 6/1955 | Freedman | 224/222 |
| 2,986,143 | 6/1961 | Eilen . | |
| 2,986,743 | 6/1961 | Eilen | 40/586 |
| 3,020,658 | 2/1962 | Clark | 40/633 |
| 3,055,133 | 9/1962 | Anderson | 40/586 |
| 3,214,852 | 11/1965 | Ford et al. | 40/586 |
| 3,543,977 | 12/1970 | Lockridge . | |
| 3,582,993 | 6/1971 | Keller | 40/586 |
| 3,586,220 | 6/1971 | Reinsberg . | |
| 4,415,106 | 11/1983 | Connell et al. . | |
| 4,432,477 | 2/1984 | Haidt et al. . | |
| 4,509,667 | 4/1985 | Meldrum . | |
| 4,581,271 | 4/1986 | Gordon | 40/586 |
| 4,616,436 | 10/1986 | De Woskin | 40/633 |
| 4,718,124 | 1/1988 | Sawicki et al. | 2/114 |
| 4,746,043 | 5/1988 | Booker . | |
| 4,956,931 | 9/1990 | Selke . | |
| 4,957,310 | 9/1990 | Bissonnette . | |
| 5,009,347 | 4/1991 | Phelps . | |
| 5,031,247 | 7/1991 | Carter | 2/242 |
| 5,092,067 | 3/1992 | Prout | 40/633 |
| 5,110,911 | 12/1992 | Tourigny . | |
| 5,170,917 | 12/1992 | Tourigny | 40/586 |
| 5,173,967 | 12/1992 | Carter | 2/242 |
| 5,183,193 | 2/1993 | Brandell | 40/90 |

FOREIGN PATENT DOCUMENTS

| | | | |
|---|---|---|---|
| 1515632 | 1/1968 | France | 224/222 |
| 473580 | 3/1929 | Germany | 224/222 |
| 3242145 | 5/1984 | Germany | 224/222 |

*Primary Examiner*—C. D. Crowder
*Assistant Examiner*—Gloria Hale
*Attorney, Agent, or Firm*—Lewis E. Massie

[57] ABSTRACT

A document holder preferably for use during outdoor activities which do not normally leave the hands free to hold a document. The document holder comprises a plurality of flexible members joined together to form a pouch with a clear or otherwise see-through sheet such as a mesh material, thereby allowing the document to be viewed. The document holder further comprises a securing means for attaching it to a wearer's arm or leg or the sleeve or pant leg of his or her garment.

1 Claim, 6 Drawing Sheets

DOCUMENT HOLDER FOR WEARER' S LIMB

CROSS-REFERENCE TO RELATED APPLICATION

This application is a continuation-in-part of application Ser. No. 07/984,880, filed Dec. 2, 1992, incorporated herein by reference, and now abandoned in favor of the present application.

BACKGROUND OF THE INVENTION

The present invention relates in general to holding documents for hands-free viewing and pertains, more particularly, to a document holder for holding a map, trail guide, schematic or some other document for viewing by the wearer during activities which do not allow continual use of the hands. The document holder of this invention is an improvement over the conventional detachable enclosures.

With the conventional holders it is generally necessary to connect a strap arrangement to secure a document holder to an arm or leg of the wearer. The straps are typically attached to the respective document holder and are then secured to attach the document holder. Another drawback associated with the conventional document holders is that straps generally require finger manipulation to attach and remove the straps to the arm or leg, difficult task to accomplish while wearing gloves.

SUMMARY OF THE INVENTION

Accordingly, it is an object of the present invention to provide an improved document holder that is adapted for ease of use, including attachment, and viewing of the document. With the document holder of this invention it is believed that even wearing an insulated jacket or pants and gloves would not interfere with the attachment and use of the present invention.

Another object of the present invention is to provide an improved document holder that is constructed to provide a shape that lends itself to secure attachment of the holder to an article of clothing typically worn during colder outside activities or while participating in other outdoor activities such as bicycling or motor cycling.

A further object of the present invention is to provide a document holder that is adapted to for use on ski jackets when either downhill or cross-country skiing, to provide substantial access to view a trail map while skiing, or for use during other activities such as bicycling, motor cycling, mountain biking, hiking, or the like, where it is desirable to have immediate visual access to a map of trails, roads, or other pathways.

Still another object of the present invention is to provide a document holder that may be readily stored. The document holder of this invention is preferably, substantially a generally flexible material that allows both flexibility and adjustability of use and the ability to be stored in a relatively small volume.

Still a further object of the present invention is to provide a document holder that is adapted for use and operation regardless of the environmental conditions. The document holder of this invention is characterized by complementary attachment members that should not be affected by most weather conditions normally experienced during outdoor activities.

To accomplish the foregoing and other objects of this invention there is provided a document holder for attaching a document to a wearer. The document is placed and held in a pocket for the wearer of the document holder to view and refer to without having to handle the document.

The document holder comprises an assembly for securing a document to an individual wearing the document holder and it includes means for providing a pocket for receiving the document, means for receiving the document in the pocket means, and means for viewing the document in the pocket means. The document holder has means for securing and releasing the pocket means on the clothing or arm or leg of the individual using the holder and means for inhibiting movement of the pocket means once it has been secured to the individual.

The pocket means has an inner member and an outer member. In a preferred embodiment the pocket means has an inner member, an outer member, and an overlapping member. The viewing means is provided by an outer member having a substantially clear portion through which the document is viewed.

The document holder is secured in place by using one securing means on an inner facing surface of the document holder and another securing means on an outer facing surface of the document holder. In one preferred embodiment one of the securing means is larger than the other. The difference in dimensions allows for adjustment of the document holder and the ability to secure the document holder in place on different size individuals and over the outside of different styles and sizes of garments, in particular winter outer wear or other generally bulky clothing worn during any number of activities.

In another preferred embodiment the document holder is also secured in place by using one securing means on an inner facing surface of a flexible member and another securing means on an outer facing surface of the flexible member. In this preferred embodiment also one of the securing means is larger than the other. This difference in dimensions also allows for adjustment of the document holder and the ability to secure the document holder in place on different size individuals and over the outside of different styles and sizes of garments, in particular winter outer wear or other bulky clothing typically worn during various outdoor activities.

In the disclosed embodiment described herein, there is provided a plurality of flexible members and associated complementary closure material located along cooperating surfaces and portions of the flexible members.

Also, it is preferred that the generally flexible members of the one preferred embodiment be a flexible material having a surface comprised of a plurality of hooks and a complementary portion of a material comprised of a plurality of loops.

In another preferred embodiment it is preferred that one of the flexible members be comprised of a clear or otherwise see through material such as a mesh material and another of the flexible members be comprised of an opaque material having at least one surface comprised of a plurality of loops and another surface with an attached complementary closure material comprised of a plurality of hooks.

The arrangement of the clear or otherwise see through material such as a mesh material or vinyl sheet is a portion forming the document pouch.

The described arrangement of one preferred embodiment of sheets of flexible material includes a clear material suitable for viewing the document through when the document is located in the pouch portion.

The described arrangement of another preferred embodiment of sheets of flexible material includes a clear or otherwise see through material such as a mesh material suitable for viewing the document through when the document is located in the pouch portion.

In the one disclosed preferred embodiment described herein the document holder includes a first generally flexible member in the shape of an irregular six-sided polygon and a second generally flexible member having at least four edges with two opposing edges having different lengths. This is one configuration that, after wrapping the document holder around the arm of a wearer, forms a generally conical shape with the smaller end towards the hand of the wearer. To help the document holder remain on the wearer's arm, there is provided a textured surface facing the wearer's arm.

To accomplish the method of the present invention there is provided a pocket means for receiving a document wherein the pocket means wraps around the wearer's arm with the document to form a generally conical shaped member. The securing assembly is provided for securing opposing edges of the pocket means together, thereby securing the pocket means to the wearer's arm.

Closing and securing the pocket means is accomplished by merely pressing the edges of the pocket means together so as to effect closure around the arm of the wearer. Releasing the pocket means from about the arm or leg is accomplished by pulling the pressed together edges apart to release the pocket means from the arm of the wearer. Both of these steps can be accomplished quickly and even while wearing some sort of glove.

In the other preferred embodiment disclosed and described herein the document holder includes a first generally flexible member in the shape of an irregular six-sided polygon with a concave depression along one arcuate edge and a second generally flexible member having at least four edges with two opposing edges having different lengths. This is one configuration that, after wrapping the document holder around the arm of a wearer, forms a generally conical shape with the smaller end towards the hand of the wearer. To help the document holder remain on the wearer's arm or leg, there is provided a textured surface on the side of the flexible member facing the wearer's arm.

To accomplish the method of the present invention there is provided a pocket means for receiving a document wherein the pocket means wraps around the wearer's arm with the document to form a generally conical shaped member. An overlapping member, is provided to substantially hold and protect the document within the pocket means. A securing assembly is further provided to secure the pocket means to the wearer's arm.

Closing and securing the pocket means with a document is accomplished by placing a document into the pocket means and tucking an edge of the pocket means under an overlapping member to hold and protect a document; and effecting closure of the securing assembly thereby securing the pocket means around the arm or leg of the wearer. Releasing the pocket means and a document from about the wearer's arm or leg is accomplished by releasing the securing assembly and pulling down and out on an edge under an overlapping member thereby allowing a document to be removed from the pocket means.

These and other objects and features of the present invention will be better understood and appreciated from the following detailed description of embodiments thereof, selected for purposes of illustration and shown in the accompanying drawings.

DETAILED DESCRIPTION

Figure 1:
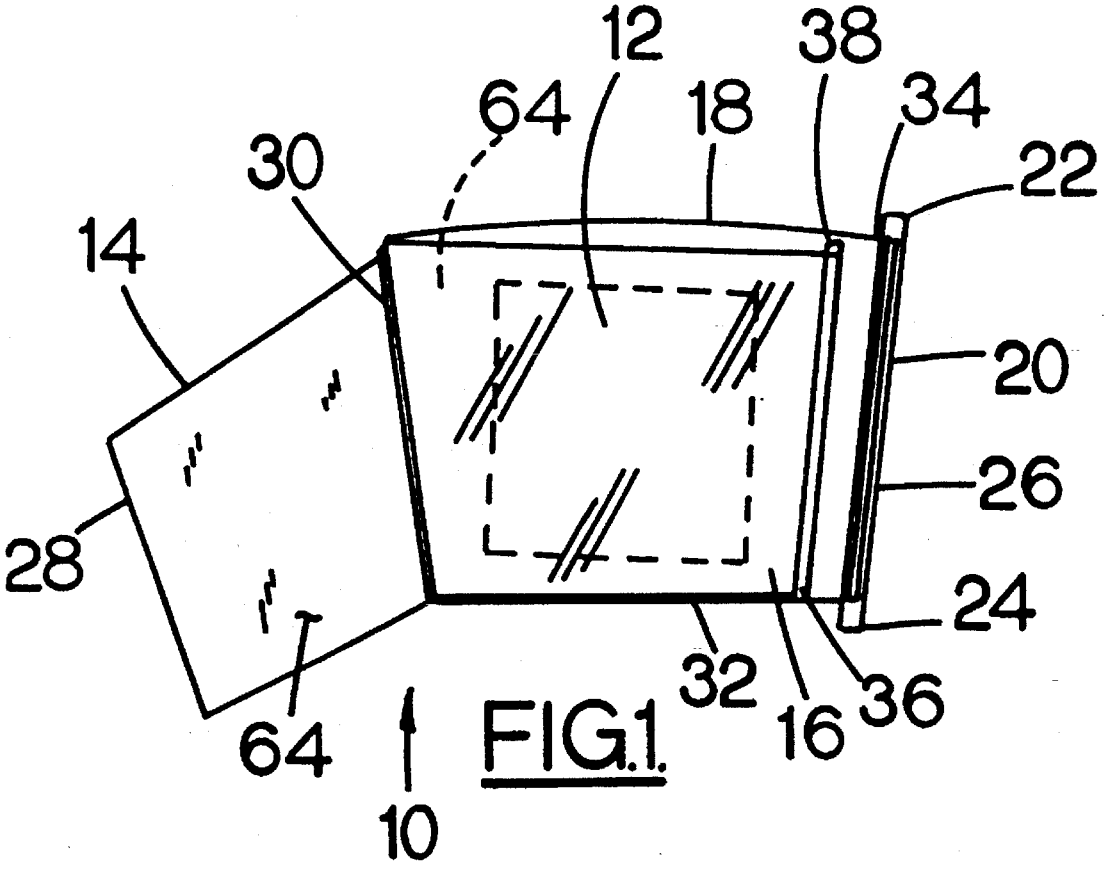
FIG. 1 is an elevation view of a document holder constructed in accordance with the present invention.
Figure 2:
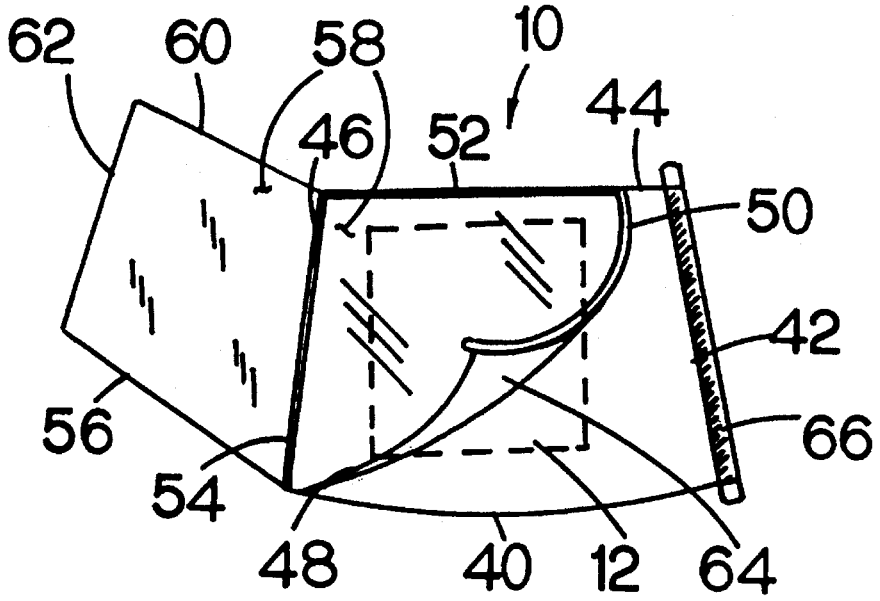
FIG. 2 is another elevation view of the document holder illustrating the reverse side of view of FIG. 1.
Figure 3:
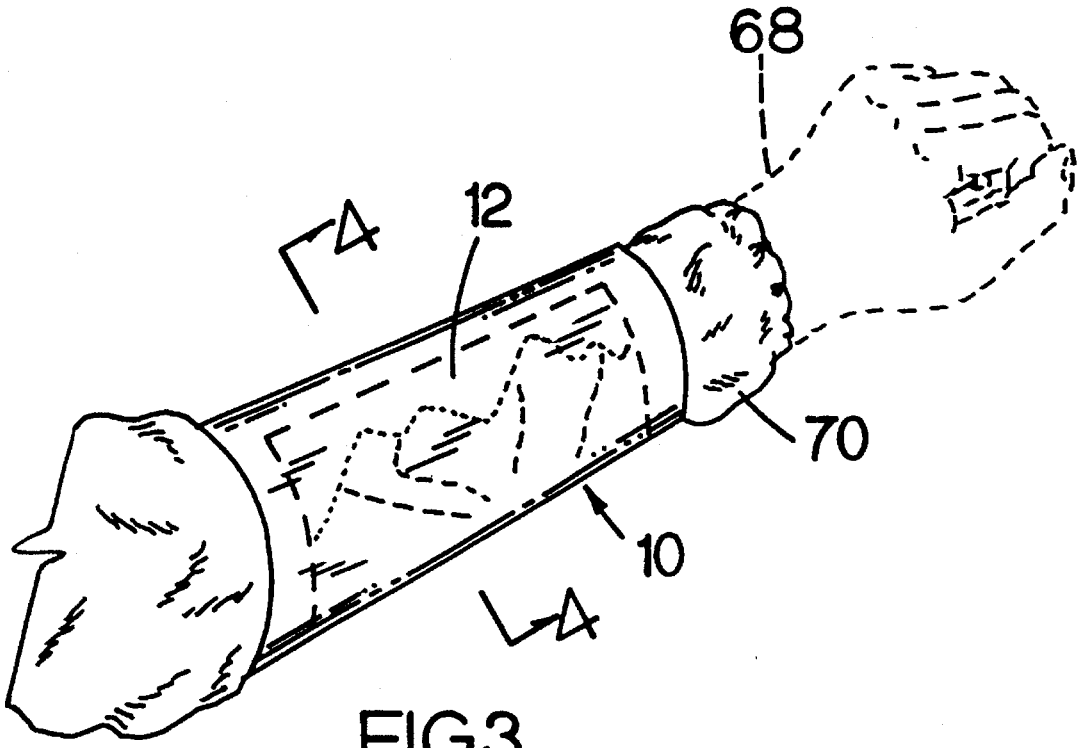
FIG. 3 is a perspective view of the of the document holder depicted in FIGS. 1 and 2.
Figure 4:
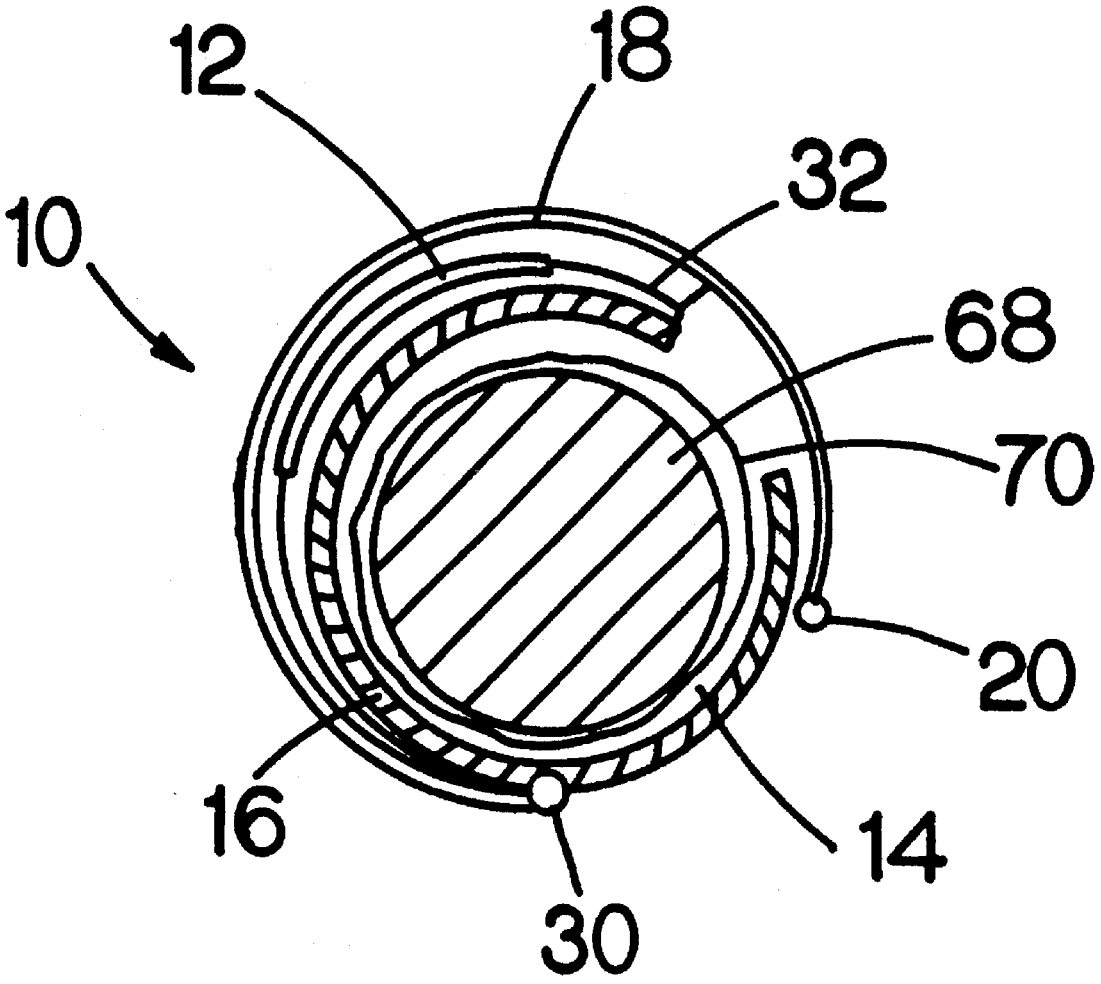
FIG. 4 is a cross-sectional view taken along line 4—4 in FIG. 3 illustrating use of the present invention on an arm or a leg.
Figure 5:
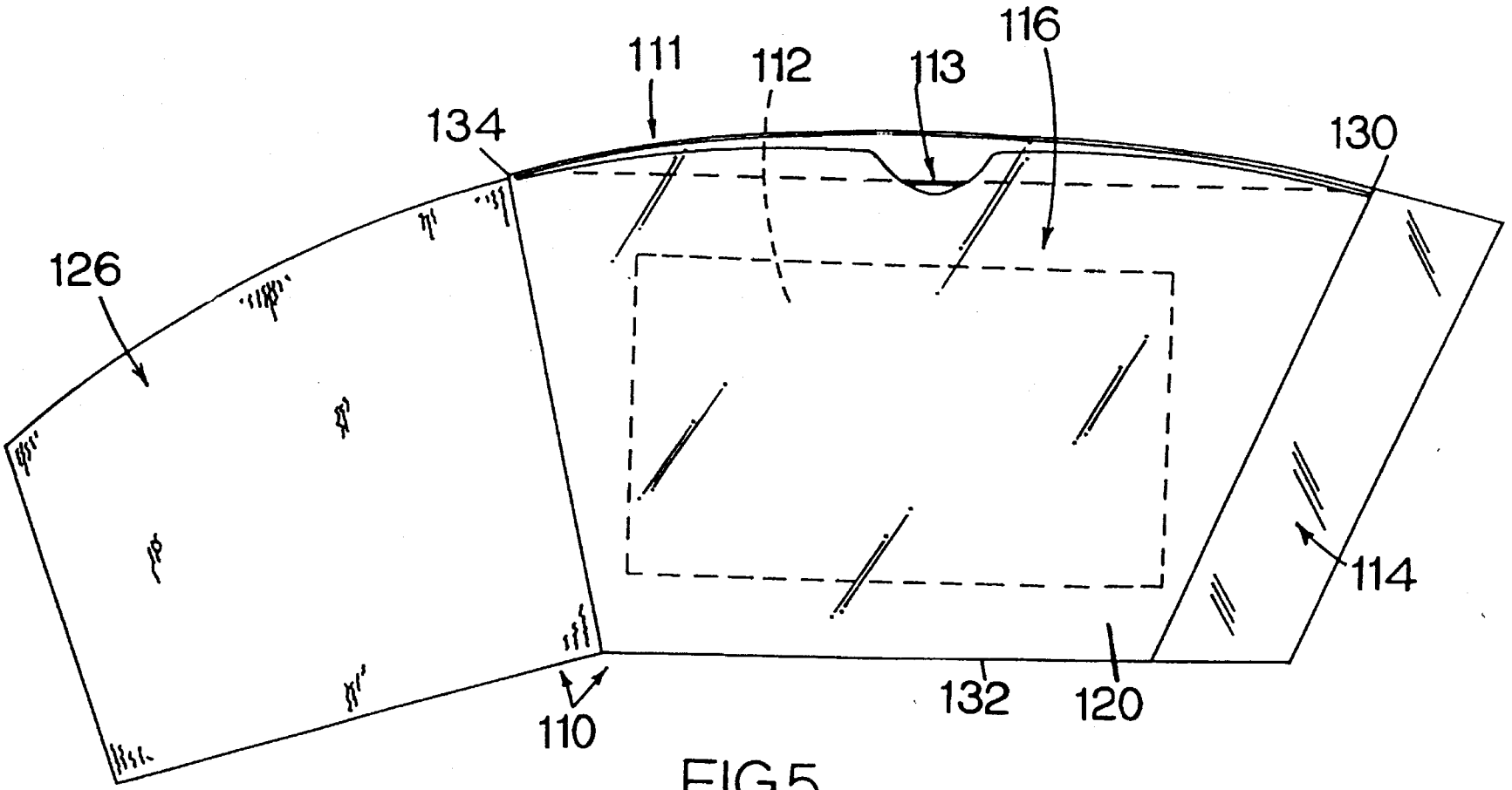
FIG. 5 is an elevation view of a document holder constructed in accordance with the present invention.
Figure 6:
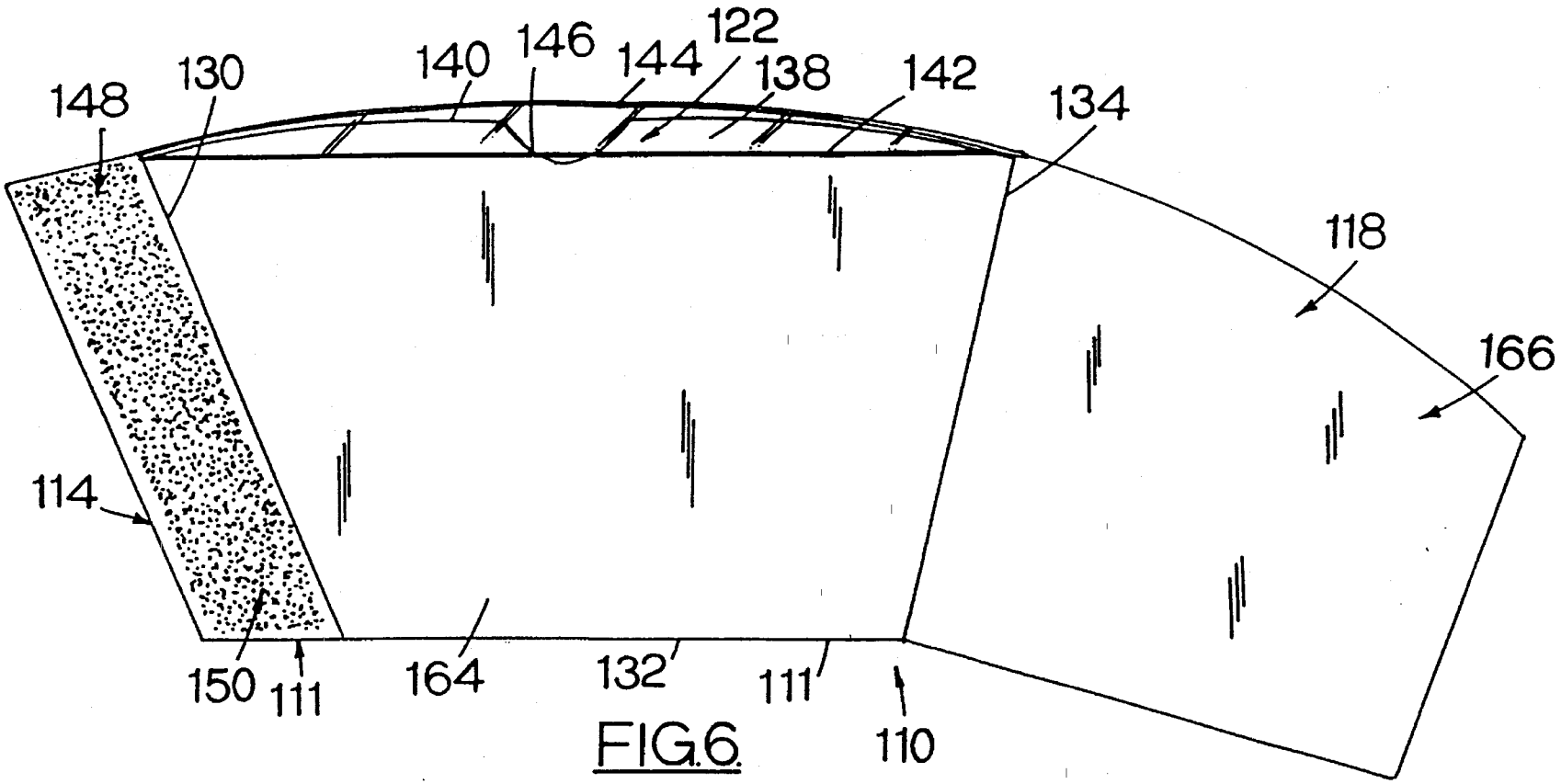
FIG. 6 is another elevation view of the document holder illustrating the reverse side of view of FIG. 5.

Referring now to the drawings, FIGS. 1–4, there is shown a preferred embodiment for the document holder of this invention. The document holder is described in connection with a ski map application to display the ski map while skiing regardless of the ability or lack of ability to fold and unfold the map while wearing ski gloves. It is understood that the use of the present invention to hold a ski trail map is just one of the numerous uses for the document holder of the present invention.

The document holder of the present invention is particularly adapted for providing increased access to the ski map of the slopes and is characterized by the ease of which the map can be viewed while wearing heavy insulated winter garments. It will be further understood that any reference herein to a single use of the present invention is for the purpose of describing an embodiment thereof and is not intended to limit the uses to which the present invention may provide a solution to the general problem of hands-free document viewing.

The drawings show the map holder 10 for holding a map 12 or other documents that comprises a first leaf having a tail portion 14 and a pouch portion 16. A second leaf 18 has a closure strip 20 with end tabs 22 and 24. The end tabs provide for grasping the edge of the second leaf to release the closure strip 20 by removing an adhering strip 26 portion from a complementary adhering material or closure portion 28.

The first leaf and second leaf are joined along an attachment seam 30 intermediate the closure strip 20 and the opposing edge of the tail portion 14. The pouch is formed by the additional joining of the first leaf pouch portion 16 and the second leaf to form edge attachment seam 32.

An end of the second leaf is joined to the closure strip 20 by an end attachment seam 34. The end of the first leaf has a reinforced edge 36 member attached by a pouch edge seam 38.

Thus it will be understood that the document receiving pouch is formed by joining the first leaf pouch portion 12 with the second leaf 18.

In operation, in connection with the ski map application (or other comparable and equivalent applications, including those previously mentioned) to hold a map of a ski slope on the arm or sleeve of a ski jacket, the pocket is provided for receiving the document, or ski map 12 in the illustrated embodiment, and the document holder is wrapped around the user's arm. The shape of the second leaf 18 is such that the document holder forms a cone-shape. The tail portion 14 extends out from the seam 30 and, due to its size and shape, provides for adjustment of the document holder on the user's arm.

The document holder is held in place and secured by pressing together the complementary closure materials. Removal of the document holder is accomplished by grasping the tabs 22 and 24 which are preferably provided to assist removal of the document holder without removing gloves.

In a preferred embodiment the second leaf has a first arcuate edge 40, a second edge 42 to which is attached the closure strip 20, a third edge 44 forming a portion of the pouch edge, and a fourth edge 46 which is joined to the first leaf at the juncture of the tail portion 14 and the pouch portion 16. The edges 42 and 46 are not parallel and that in conjunction with the arcuate edge 40 provides the generally conical shape when the document holder 10 is rolled or wrapped around the user's arm.

The first leaf has a first edge 48 providing one free edge of the pouch, a second edge 50 which is reinforced and forms the other free edge of the pouch. A third edge 52 is joined to the second leaf and forms seam 54 and one sealed edge of the pouch. A fourth edge 56 forms one side of the tail portion 14 of the first leaf.

It will be noted that a rear surface 58 of the first leaf can be provided with a textured surface. The textured surface assists the document holder by providing frictional resistance against removing the document holder or its sliding off the wearer's arm, particularly if the garment being worn has a generally smooth surface, similar to that found with respect to a conventional ski jacket.

A fifth edge 60 and a sixth edge 62 form the remaining free edges of the tail portion 14 of the first leaf.

The entire surface 64 consists of the closure material. This accomplishes at least two objectives. First, the size of the tail allows adjustment of document holder size when in place and used as intended since the complementary closure strip 66 can be affixed anywhere on the surface 64 to obtain the desired closure. Second, the relatively rough surface in the preferred embodiment assists in maintaining the map or other document in place within the pouch.

An arm and hand 68 of a wearer is illustrated within an outer garment 70 showing how the document holder can be affixed to the sleeve for viewing and referring to a document depicted as a ski slope map in the embodiment depicted in the drawings.

Referring again to the drawings there is shown another preferred embodiment for the document holder of this invention.

The drawings, FIGS. 5–8, show the document holder 110 for holding a document 112 that comprises a first generally flexible member 111, having a first leaf 164, an end portion 114, and a tail portion 118; a second generally flexible member 113, having a second leaf 120 and an overlapping third leaf 138; and a closure strip 148.

A middle pocket 116 is formed by joining the first leaf 164 and the second leaf 120, along first edge attachment seam 130, second edge attachment seam 132, and third edge attachment seam 134. The first and third edge attachment seams 130 and 134 are located intermediate the end portion 114 and the opposing edge of the tail portion 118. The first and third edge attachment seams 130 and 134 are not parallel and that in conjunction with a second arcuate edge 144 of the first leaf 164 provides the generally conical shape when the document holder 110 is rolled or wrapped around the user's arm or leg 168.

Thus it will be understood that a document receiving pouch is formed by joining the first leaf 164 to the second leaf 120.

In operation, in connection with the trail map application previously mentioned (or any other of the various applications for the present invention from hiking to bicycling or the like) to hold a map of a trail on the arm or leg 168 or outer garment or pants 170, the middle pocket 116 is provided for receiving the document 112 in the illustrated embodiment, and the document holder is wrapped around the user's arm or leg 168. The shape of the second leaf 120 is such that the document holder forms a cone-shape. The tail portion 118 extends out from the third edge attachment seam 134 and, due to its size and shape, provides for adjustment of the document holder on the user's arm or leg 168.

In this preferred embodiment, the entire top surface 165 of the first flexible member 111 comprises a textured closure material consisting of a plurality of loops 126. This accomplishes at least two objectives. First, the size of the tail portion 118 allows adjustment of document holder size when in place and used as intended, since the complementary closure strip 148 can be affixed anywhere on the top surface 165 of the first flexible member 111 in order to obtain the desired closure. Second, the textured surface in the preferred embodiment assists in maintaining the map or other document in place within the pouch.

The document holder is held in place and secured to the arm or leg of the wearer by pressing together the complementary closure material comprising a plurality of loops 126 and hooks 148. Removal of the document holder is accomplished by grasping the end portion 114 and pulling it apart, allowing the user to easily remove the document holder 110 even when wearing gloves.

In this preferred embodiment the second leaf 120 and the third leaf 138 are attached together at a first arcuate edge 144, the attachment forming a small fold 122 for receiving an arcuate edge 140 of the member 164. The edge 140 of 164 is tucked under the third leaf 138 and into a receiving fold or pocket 122.

Thus it will be understood that the small receiving fold 122 is formed by joining the second leaf portion 120 with the third leaf portion 138.

The arcuate edge 140 of the first leaf 164 additionally comprises a centered concave edge portion 146 collectively forming the free edge of the middle pocket 116. The arcuate edge 140 can be tucked under the reinforced edge 144 and into the receiving fold 122, providing optional added protection to the contents of the middle pocket 116 before wrapping the pouch around the user's arm or leg 168.

When the arcuate edge 140 is tucked into the secondary fold 122, the concave edge portion 146 sits below a reinforced edge 142 of the third leaf 138 allowing for easy access to the contents of the middle pocket 116 when the wearer utilizes a downward and outward movement.

The closure strip 148, preferably comprising a plurality of hooks 150, is joined to and extends from the member 164.

In operation, the middle pocket 116 is provided for receiving the document 112 in the illustrated embodiment, and the document holder is wrapped around the user's arm or leg 168. The shape of the second leaf 120 is such that the document holder forms a cone shape. The tail portion 118 extends out from the third edge attachment seam 134 and, due to its size and shape, provides for adjustment of the document holder on the user's arm or leg 168.

In a preferred embodiment, the first leaf 164 includes the arcuate edge 140 with a centered concave edge portion 146, together providing a free edge of the middle pocket 116. The closure strip 148 is attached to the member 164.

It will be noted, that the bottom surface 166 of the first flexible member 111 can be provided with a non-smooth surface. The non-smooth surface assists the document holder by providing frictional resistance against its sliding around on the wearer's arm, particularly if the garment being worn has a generally smooth surface such as a conventional nylon jacket.

Figure 7:
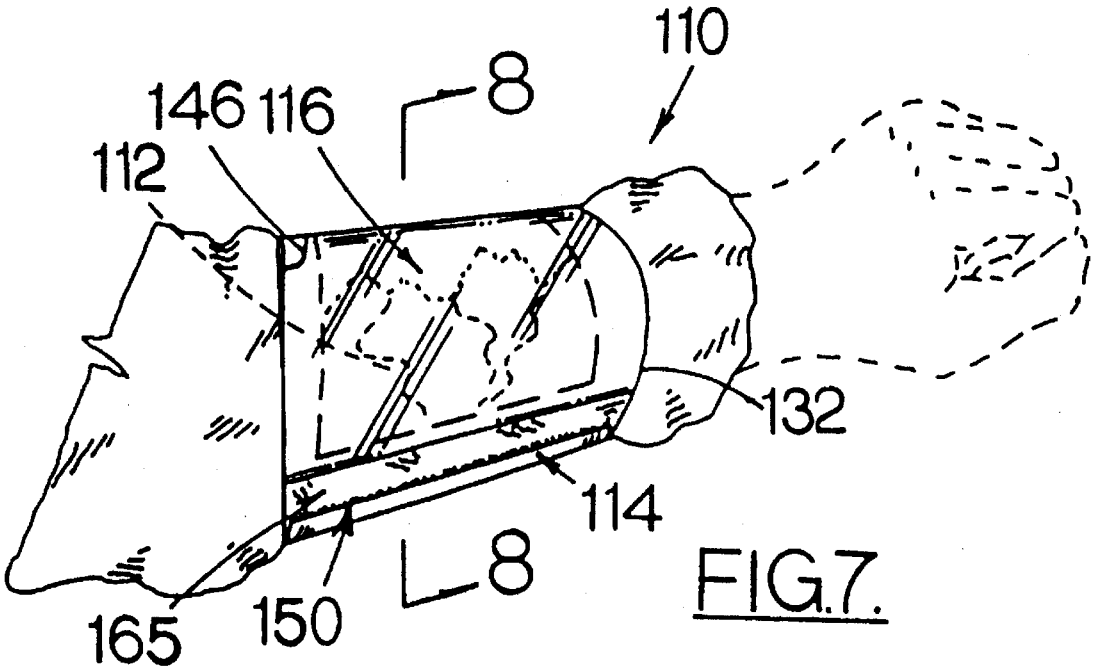
FIG. 7 is a perspective view of the of the document holder depicted in FIGS. 5 and 6.
Figure 8:
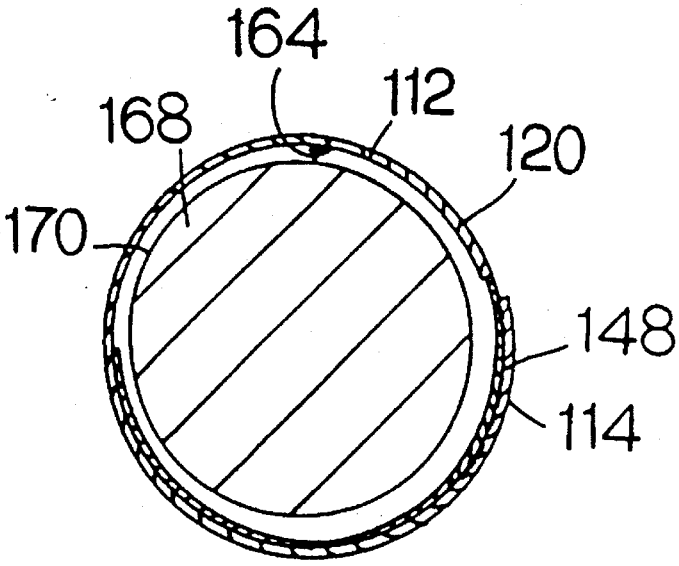
FIG. 8 is a cross-sectional view taken along line 8—8 in FIG. 7 illustrating use of the present invention on an arm or a leg.

An arm or leg 168 of a wearer is illustrated in FIGS. 7 and 8 within an outer garment 170 showing how the document holder can be affixed to the sleeve or the pant leg for viewing and referring to a document 112 in the embodiment depicted in the drawings.

From the foregoing description those skilled in the art will appreciate that all of the objects of the present invention are realized. A document holder has been shown and described for providing the desired placement of a document for viewing while engaged in an activity that does not lend itself to additional use of the hands, such as downhill or cross-country skiing, hiking, bicycling, motor cycling, or the like. The conical shape lends itself to secure attachment of the holder to the arm or leg with or without an article of clothing underneath.

It will be appreciated that the present invention has overcome a number of the drawbacks of the conventional device for holding a document for virtually hands-free viewing. The present invention, for example, does not require straps or any other holding means that would require the user to clasp, buckle, tie or otherwise bind a document holder in order to hold it in place.

The flexibility of the preferred materials allows both flexibility and adjustability of use and the ability to be stored in a relatively small volume. The use of suitable vinyl sheeting with hook and loop materials to construct the present invention allows use and operation regardless of the environmental conditions. The complementary attachment members should not be affected by most weather conditions normally experienced during outdoor activities in any season.

While specific embodiments have been shown and described, many variations are possible. The particular shape of the leaves including dimensions and materials may be changed as desired to suit the application for which it is intended. The first leaf is preferably the same size or larger than the adjoining portion of the second leaf, and the third leaf is preferably the same size or smaller than the adjoining portion of the second leaf.

The housing materials may vary although the preferred embodiment uses conventional hook and loop closures provided in sheet form. Both the velcro loop sheets and the clear vinyl are either die cut or otherwise obtained in sheet form and manufactured according to the desired size and shape.

Since reference character 168 has been used to refer to the arm or leg of someone using the present invention, it will be understood that the present invention is intended to be worn in any convenient fashion. A stated objective of the present invention is to allow a map or other document to be seen and referred to during an activity in which it may be difficult or impossible to handle the document or retrieve the document from a pouch or pocket. Additionally, another objective of the present invention allows for easy access, both in putting it on and removing it with or without gloves.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of the invention be determined by appended claims and there equivalents.

What is claimed is:

1. A flexible document holder to be worn by a skier or others to display a trail map or other document for viewing, wherein the first generally flexible member is an irregular six-sided polygon and the second generally flexible member has at least four edges with at least two opposing edges having different lengths, such that wrapping the document holder around a limb of the wearer forms a generally conical shape;

a. a first generally flexible member, having a plurality of peripheral edge portions, at least a portion of one surface of the first generally flexible member having a closure material;

b. a second generally flexible member joined to the first generally flexible member to form a document receiving pouch, the second generally flexible member at least as large as the adjacent portion of the first generally flexible member defined by the joining between the first generally flexible member and the second generally flexible member; and c. a complementary closure material attached to at least a portion of another surface of the first generally flexible member, the complementary closure material compatible with the closure material on the surface of the first generally flexible member.

* * * * *